US007433269B2

(12) United States Patent
Vuilleumier et al.

(10) Patent No.: US 7,433,269 B2
(45) Date of Patent: Oct. 7, 2008

(54) TIMEPIECE WITH ANALOG DISPLAY CAPABLE OF INDICATING A DATE OF ONE CALENDAR IN ANOTHER CALENDAR

(75) Inventors: Alain Vuilleumier, La Chaux-de-Fonds (CH); Jean-Jacques Born, Morges (CH)

(73) Assignee: ASULAB S.A., Marin (CH)

( * ) Notice: Subject to any disclaimer, the term of this patent is extended or adjusted under 35 U.S.C. 154(b) by 0 days.

(21) Appl. No.: 11/277,630

(22) Filed: Mar. 28, 2006

(65) Prior Publication Data

US 2006/0221772 A1 Oct. 5, 2006

(30) Foreign Application Priority Data

Mar. 30, 2005 (EP) ..... 05006853

(51) Int. Cl.
*G04B 19/26* (2006.01)

(52) U.S. Cl. ..... 368/18; 368/28; 368/37

(58) Field of Classification Search ..... 368/28, 368/15–20; 33/1 SA, 1 SC
See application file for complete search history.

(56) References Cited

U.S. PATENT DOCUMENTS

| | | | | |
|---|---|---|---|---|
| 1,997,511 | A * | 4/1935 | Canepa | 368/18 |
| 4,731,767 | A * | 3/1988 | Uehara | 368/15 |
| 4,881,213 | A * | 11/1989 | Zaslawsky | 368/15 |
| 5,086,416 | A * | 2/1992 | Dubois et al. | 368/18 |
| 5,457,663 | A | 10/1995 | Mejaski | |
| 5,764,597 | A | 6/1998 | Shih et al. | |
| 5,802,016 | A * | 9/1998 | Kubota et al. | 368/11 |
| 6,108,640 | A | 8/2000 | Slotznick | |
| 6,272,076 | B1 * | 8/2001 | Dinger | 368/15 |
| 6,359,839 | B1 * | 3/2002 | Schenk et al. | 368/16 |
| 6,580,663 | B1 | 6/2003 | Whitmore | |
| 6,776,618 | B1 * | 8/2004 | D'Zmura | 434/106 |
| 2004/0047243 | A1 * | 3/2004 | Karageorge | 368/28 |

FOREIGN PATENT DOCUMENTS

| | | |
|---|---|---|
| EP | 783 994 A1 | 10/1996 |
| EP | 949 549 A1 | 10/1999 |
| GB | 2 219 108 A | 11/1989 |
| JP | 56-74683 | 11/1979 |

* cited by examiner

*Primary Examiner*—V. W. Miska
*Assistant Examiner*—Sean Kayes
(74) *Attorney, Agent, or Firm*—Sughrue Mion, PLLC

(57) ABSTRACT

The invention relates to an electronic timepiece comprising manual control means (21, 23) for the selection of different modes and an analog display provided with indicators (26, 27, 28, 32, 34) moved separately by electric motors to indicate the time on a dial (22) in a time mode and other information in one or more other modes, said indicators comprising at least an hour hand (26), a minute hand (27), a day indicator (32) and a month indicator (34). In addition, at least one of the modes to be selected is an event indication mode, in which the Gregorian date of a movable event is delivered by the electronic circuits of the timepiece and is displayed at least by the day indicator (32) and month indicator (34), said timepiece having means for the display of the number of the Gregorian year.

2 Claims, 9 Drawing Sheets

TIMEPIECE WITH ANALOG DISPLAY CAPABLE OF INDICATING A DATE OF ONE CALENDAR IN ANOTHER CALENDAR

This application claims priority from European Patent Application 05006853.5 filed 30 Mar. 2005, the entire disclosure of which is incorporated herein by reference.

BACKGROUND OF THE INVENTION

The present invention relates to an electronic timepiece, in particular a wristwatch, comprising manual control means for the selection of different modes and an analog display provided with indicators moved separately by electric motors to indicate the time on a dial in a time mode and other information in one or more other modes, said indicators comprising at least an hour hand and a minute hand.

An astronomical wristwatch having these features is described in the patent application EP 949 549 and by means of hour and minute hands can display various astronomical indications in various modes selected by the user. Apart from the time mode, the main function of each of the other modes is to indicate through a hand the direction of a star of the solar system in relation to the zodiac, which is shown on the dial. The watch can also display dates, in particular by means of a numeric display, and provide the above-mentioned astronomical indications for past or future dates.

Moreover, electronic timepieces with electro-optical cell numeric displays are known that are capable of displaying a wide variety of astronomical magnitudes as well as dates. Descriptions of such timepieces are to be found in the patent publications U.S. Pat. No. 5,457,663, U.S. Pat. No. 6,580,663 and JP 56-074683, for example. However, these displays are essentially complex and difficult to read, such that they are not always readily understood.

SUMMARY OF THE INVENTION

A basic concept of the present invention is to equip a timepiece with means to convert in an extremely simple manner the date of a movable event of a different calendar from the Gregorian calendar, e.g. the Chinese or lunar calendar, into a date of the Gregorian calendar.

More particularly, the invention relates to a timepiece of the type indicated in the above introduction, characterised in that said indicators comprise a day indicator and a month indicator, and that at least one of the modes to be selected is an event indication mode, in which the Gregorian date of a movable event is delivered by the electronic circuits of the timepiece and is displayed at least by the day indicator and month indicator, said timepiece having means for the display of the number of the Gregorian year.

In a particular embodiment of the invention, the event is the Chinese New Year of the current year or a past or future year.

BRIEF DESCRIPTION OF THE DRAWINGS

Other features and advantages of the present invention shall be made clear from the following description, which illustrates two advantageous embodiments as non-restrictive examples with reference to the attached drawings, wherein.

DETAILED DESCRIPTION OF TWO EMBODIMENTS OF THE INVENTION

Figure 1:
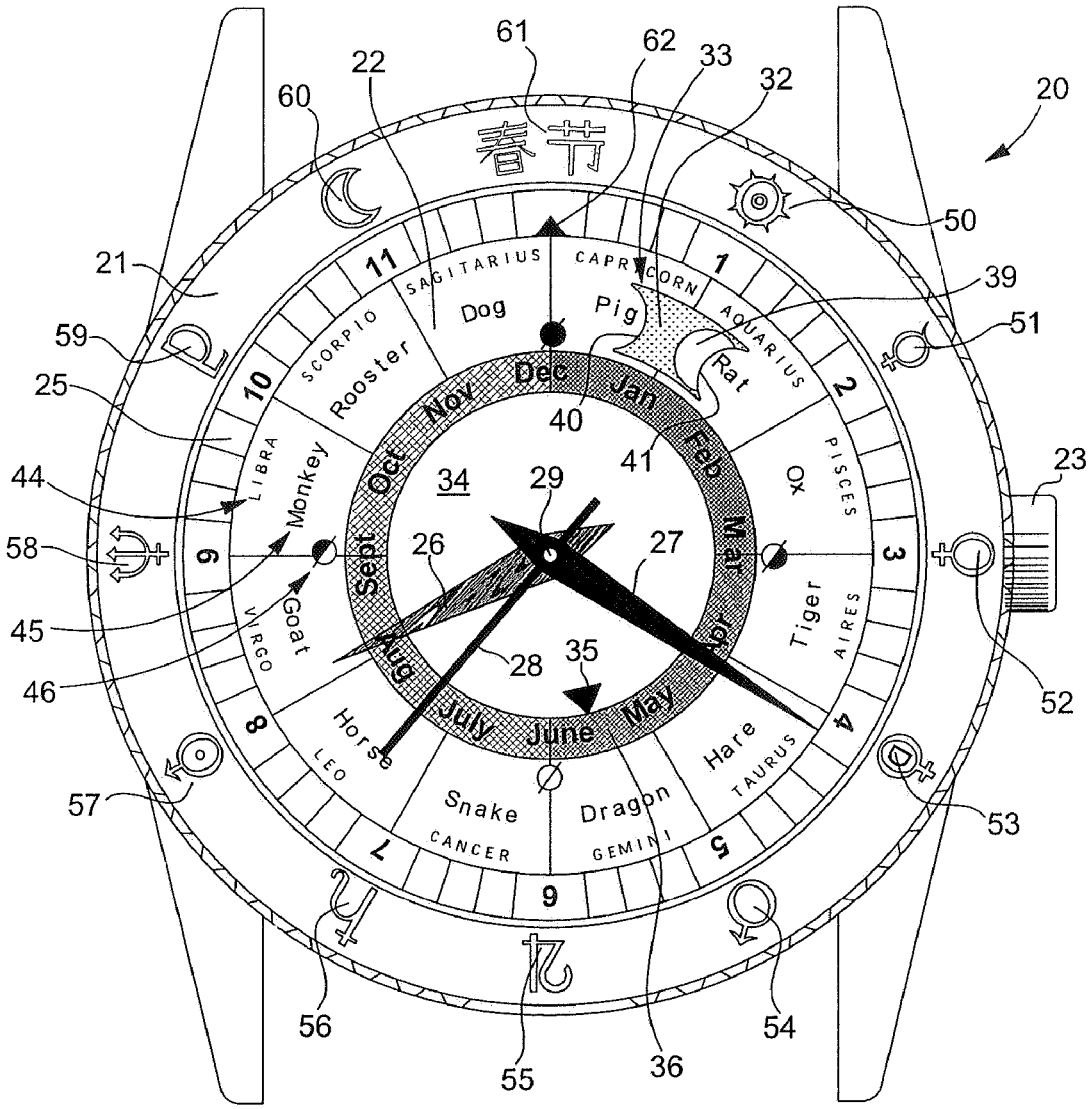
FIG. 1 is a schematic plan view of a first embodiment of a wristwatch according to the invention, in a time display mode.

In the first embodiment illustrated in FIGS. 1 to 6, the watch 20 has a case configured like that of the watch described in the patent application EP 949 549, with a revolving bezel 21, which encircles the glass and the dial 22, and an external crown 23 connected to a rotary control pin, which has several axial positions, one of which is a pressed position, which closes an electrical contact, and the pin and crown are then returned to a neutral position by a spring. The revolving bezel 21 and the crown 23 form the manual control means of the watch.

The dial 22 is associated with an analog time display comprising a classic time ring 25 and hour 26, minute 27 and second 28 hands with a common axis of rotation 29 at the centre of the dial. The watch additionally has a calendar display comprising a day disc 32, a small portion of which is visible in a window 33 of the dial, and a month indicator disc 34, which has a pointer 35 facing a scale of months 36. In this example, the two calendar indicators 32 and 34 revolve around the axis 29 of the hands, however a different arrangement is obviously possible. The five indicators formed by the hands 26 to 28 and discs 32 and 34 are moved individually with suitable reducing gears by five electric stepping motors driven by the electronic circuits of the watch.

Figure 2:
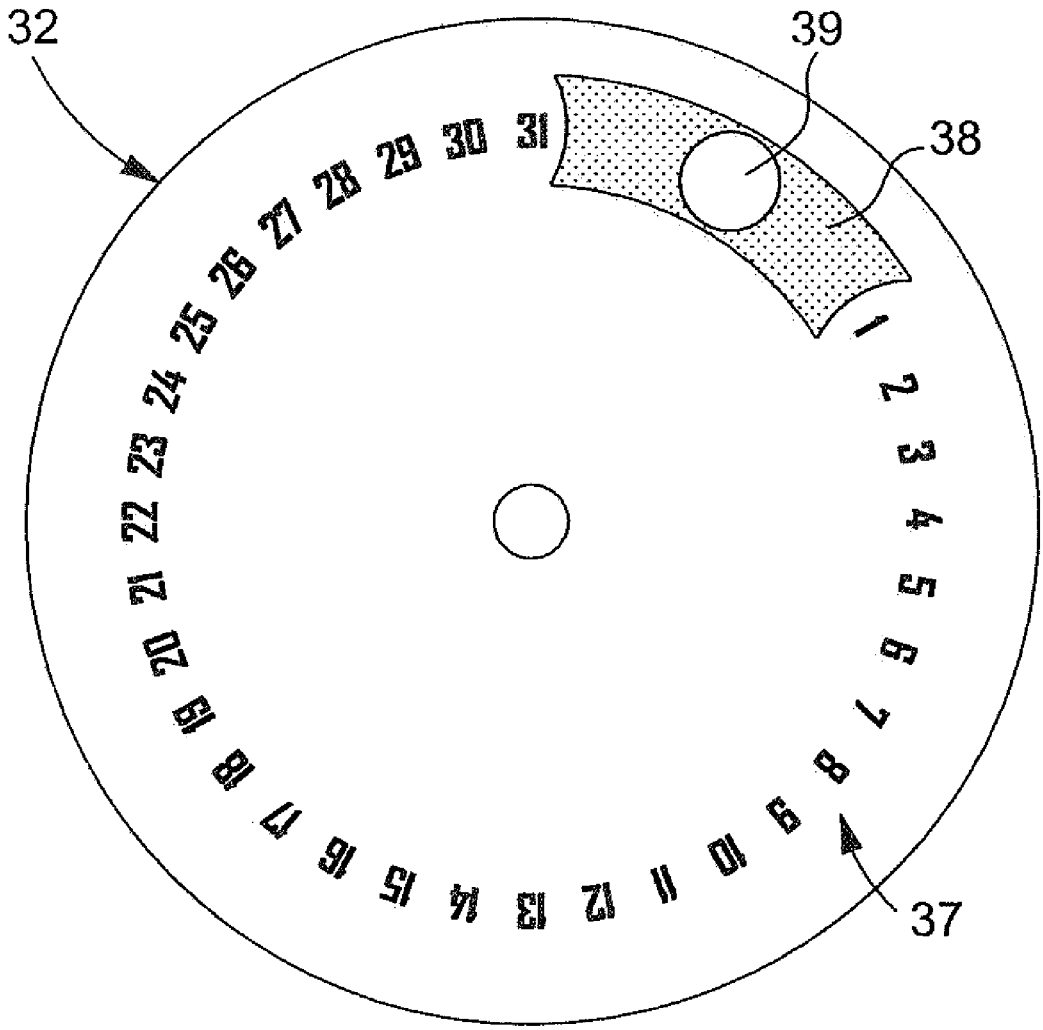
FIG. 2 shows a day and moon disc of the watch.

The day indicator disc 32, which is shown in particular in FIG. 2, is designed to be able to indicate not only the day but also the phases of the moon in the window 33. This is why the series of days (given the reference 37) from 1 to 31 only occupies a section of a circumference of the disc, while the rest of this circumference is occupied by a dark field 38, at the centre of which a circular image 39 of the moon in a bright colour is located. In the manner known in this type of display of the phases of the moon, the window 33 has an elongated form, the two ends 40 and 41 of which are convex towards the interior of the window in order to scroll successively to the image 39 of the moon to represent its appearance in the sky at the current date. The disc 32 is moved by its electric motor with a very high a reduction ratio, e.g. in the order of 1:1000, which enables it to display a large number of different positions of the image 39 of the moon in the window 33, in particular a different position each day.

Inside the time ring 25, the dial 22 is divided into twelve equal sectors, in which are respectively inscribed the Latin names of the constellations 44 of the western zodiac and the English names of the constellations 45 of the Chinese zodiac, which are also the earthly branches used to denote the years of the Chinese lunisolar calendar: rat, ox, tiger, hare, dragon, snake, horse, goat, monkey, rooster, dog and pig.

The revolving bezel 21 serves as selector for various function modes of the watch 20. It is provided with the astronomical functions already described in patent application EP 949 549 mentioned above, which is incorporated herein by reference and to which the reader may refer for more details concerning the astronomical functions described below and the construction of the watch with respect to these functions. It should just be mentioned here that to select the function modes, the different positions of the bezel can be detected and indicated to the electronic circuits of the watch by any type of known device, e.g. that of the watch described in the patent application EP 738 994, which is formed by magnets included in the bezel and Reed contacts positioned inside the watch.

Moreover, the dial bears a set of four symbols 46 shifted 90° relative to one another and representing the winter solstice, vernal equinox, summer solstice and autumn equinox respectively.

The watch 20 has a standard function mode and twelve special function modes, for which twelve corresponding symbols are arranged at equal intervals on the bezel 21. These symbols are that of the sun 50, symbols 51 to 59 of the nine planets of the solar system, symbol 60 of the moon and a symbol 61 of the Chinese New Year.

In the standard mode, the bezel 21 can be in any position, since the watch automatically resets to this standard mode after a predetermined period of time (e.g. 10 seconds) has elapsed in another mode. As FIG. 1 shows, the hands 26 to 28 then indicate the current time, the disc 32 indicates either the current day or the phase of the moon if the last mode selected was the Moon mode, and disc 34 indicated through its pointer 35 the month, or more precisely the date throughout the scale of months 36.

When one of symbols 50 to 61 is moved to face the pointer 62 positioned at 12 o'clock on the dial, the display remains in standard mode. It is only when the crown 23 is pressed briefly that the mode corresponding to the symbol is engaged for the above-mentioned period of time, then the watch returns to standard mode.

Figure 3:
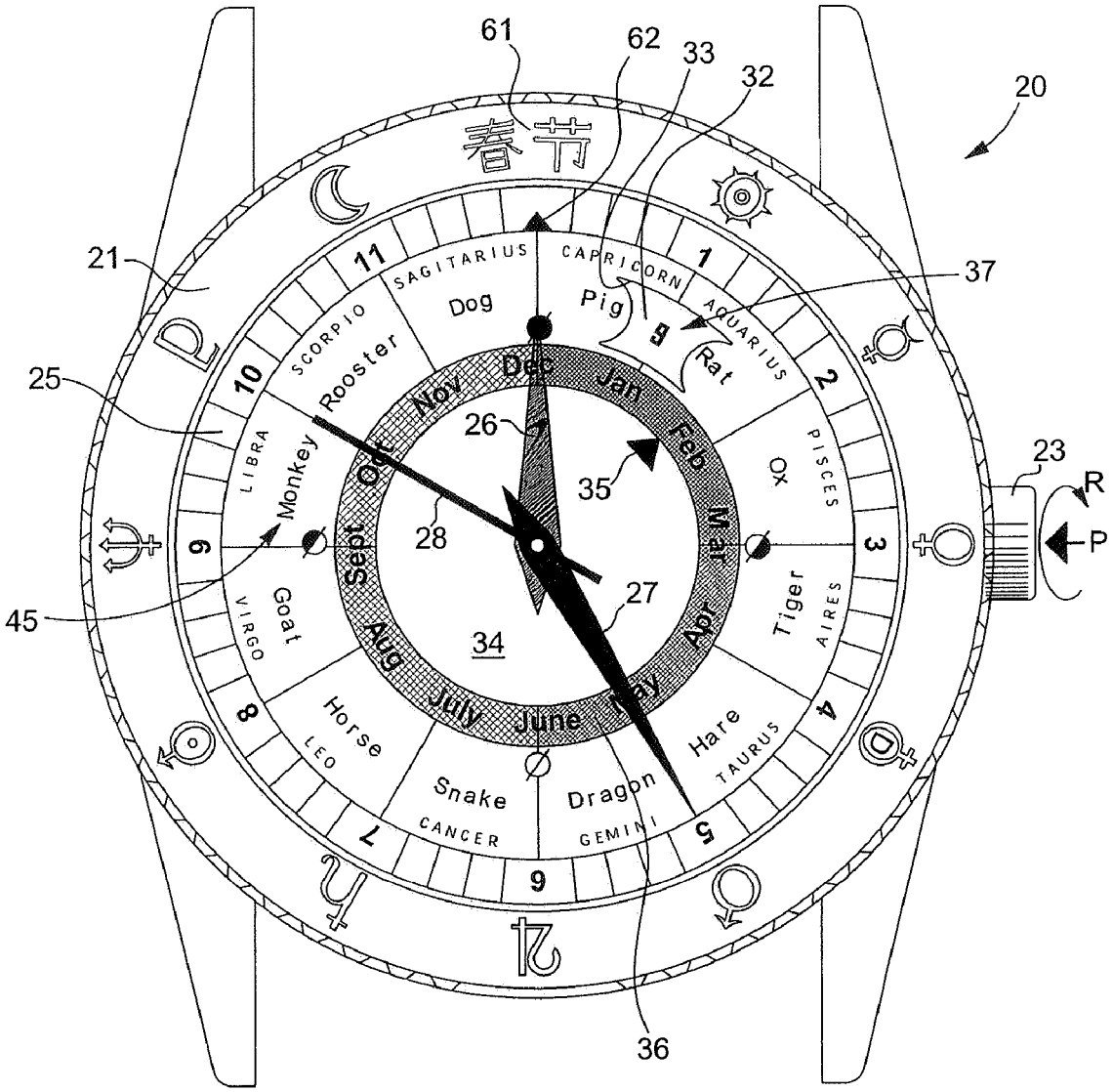
FIG. 3 shows the watch of FIG. 1 displaying the date of the Chinese New Year of the current year.
Figure 4:
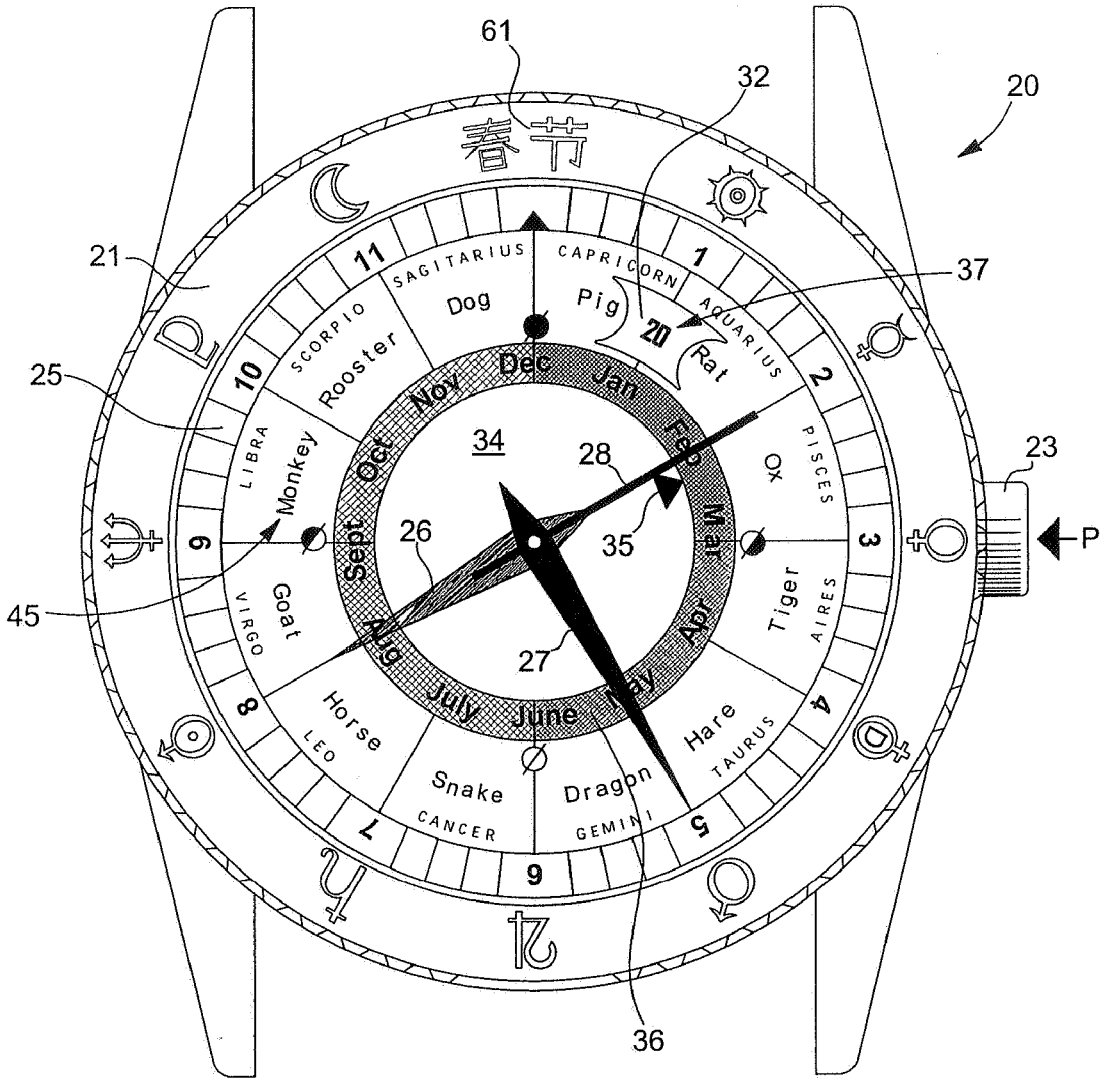
FIG. 4 shows the watch of FIG. 1 displaying the date of the Chinese New Year of a previous year.

FIG. 3 shows the type of display obtained in the mode indicating the Chinese New Year (festival day mode), which is selected by positioning the corresponding symbol 61 to face the pointer 62 of the dial and is engaged by briefly pressing (represented by the arrow P) the crown 23. The display then indicates the Gregorian date of the Chinese New Year of the current year in the following manner: the discs 32 and 34 respectively indicate the day 37 and the month in the Gregorian calendar, while the two last digits of the Gregorian year are indicated by the hands 26 and 27 via the digits of the time ring 25, hand 26 indicating the tens digit (here 0) and hand 28 indicating the units digit (here 5). In turn, the second hand 28 is positioned with respect to the sectors representing the earthly branches of the Chinese years indicating the earthly branch of the year following the New Year or, as FIG. 3 shows, being positioned at the boundary between the two sectors, whose earthly branches correspond to the previous year and the following year. In the case shown in FIG. 3, the display represents a Chinese New Year at the date of 9 Feb. 2005, marking the start of the year of the Rooster.

In this mode, a rotation of the crown 23 into its neutral position causes the year to be incremented if the crown is turned in the direction of the arrow R, or decremented if rotated in the reverse direction. The user can thus cause the Gregorian date of the Chinese New Year to be displayed in a range of a hundred years, extending here from 1951 to 2050. For example, in FIG. 4 the indicator elements 26, 27, 28, 32 and 35 show that in 1985 the Chinese New Year fell on 20 February and formed the passage of the year of the Rat to the year of the Ox.

The user can then choose another year by turning the crown 23 or returning to the current year by applying renewed pressure P on the crown. If no application of pressure is made on the control elements 21 and 23 for the predetermined period mentioned above, the display returns to the standard mode.

To display the date of the Chinese New Year just described, the electronic circuits of the watch drive the five motors of the display on the basis of five corresponding variables which are recorded in the form of a table in a non-volatile memory. The line-by-line navigation in this table can be easily controlled by means of two circuit breakers activated by rotation of the pin associated with the crown 23. These are techniques well known to a person skilled in the art and therefore there is no need to describe them in detail here.

It shall be readily understood that the function mode just described is not restricted to the display of one or more dates of the Chinese New Year, as it can be used in the same manner to display the Gregorian date of whatever event in the year, since the successive dates of this event can be stored in memory beforehand or calculated by an algorithm in the electronic circuits of the watch. It can also be provided that the same watch can display the dates of different movable events represented by different symbols on the bezel 21 to represent various modes corresponding to these events, wherein the word "event" can signify a festival day or any date characteristic of a non-Gregorian calendar, e.g. the start of a particular month such as the month of Ramadan.

Figure 5:
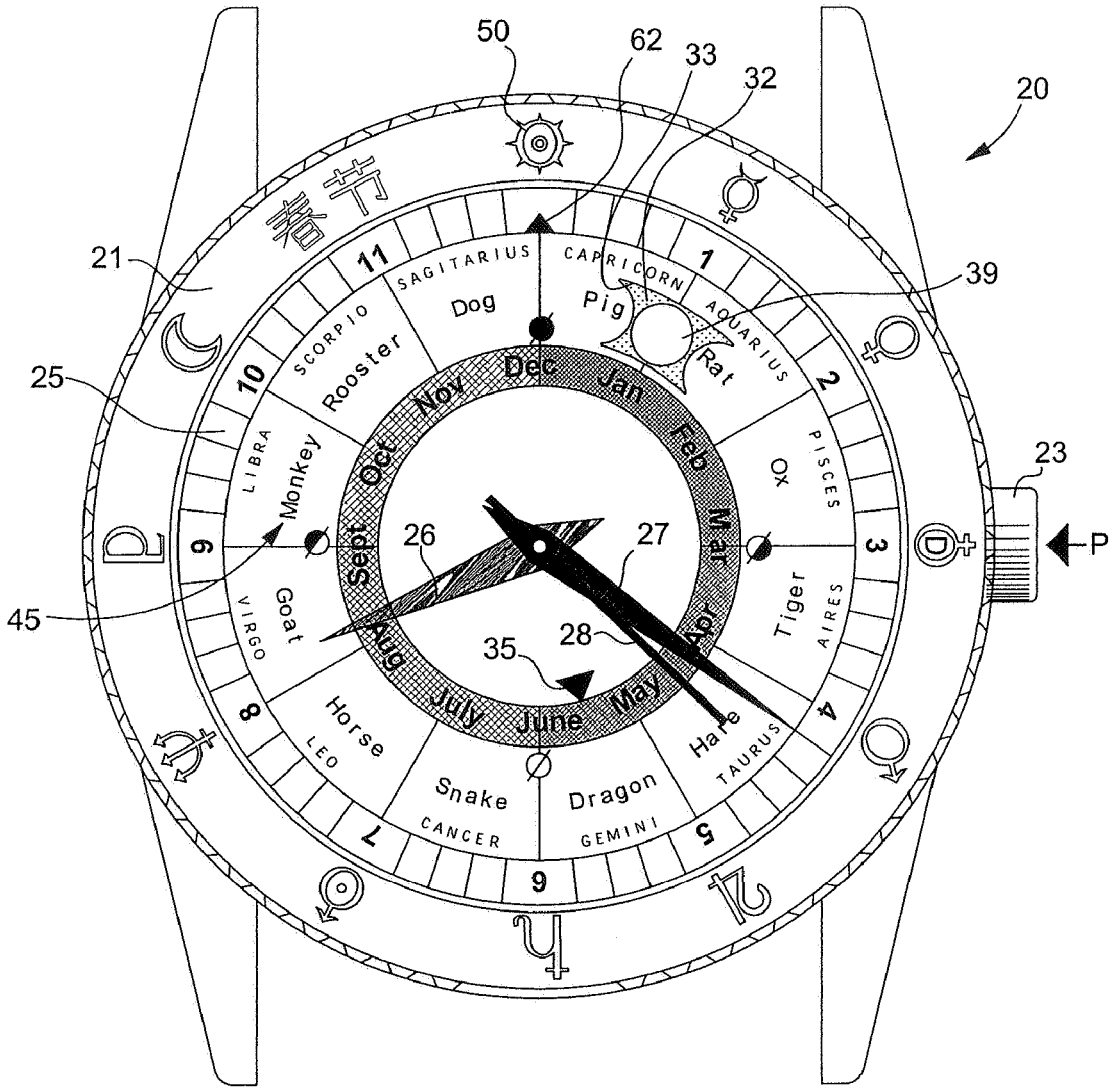
FIG. 5 shows the watch of FIG. 1 in an astronomical display mode.

The astronomical modes represented by symbol 50 of the sun and symbols 51, 52, 54, 55, 56, 67, 58 and 59 of the planets other than the earth have the following effect: the second hand 28 moves to a position where it indicates the current position of the selected star in the zodiac on the dial. As shown in FIG. 5, the display then shows the hands 26 to 28 continuing to indicate the current time. In a variant not provided here, the hand 28 could also indicate the position of the planet in question at a past or future date selected by rotating the crown 30, as is described in the patent application EP 949 549.

In the Earth mode corresponding to symbol 53, the display remains in standard mode with the indication of the day in window 33, i.e. that if the phase of the moon is displayed, as in the case of FIG. 1, it is replaced by indication of the current day. Thus, the user can choose to permanently display either the day by selecting the Earth mode, or the phase of the moon by selecting the Moon mode and allowing the watch to return to the standard mode.

Figure 6:
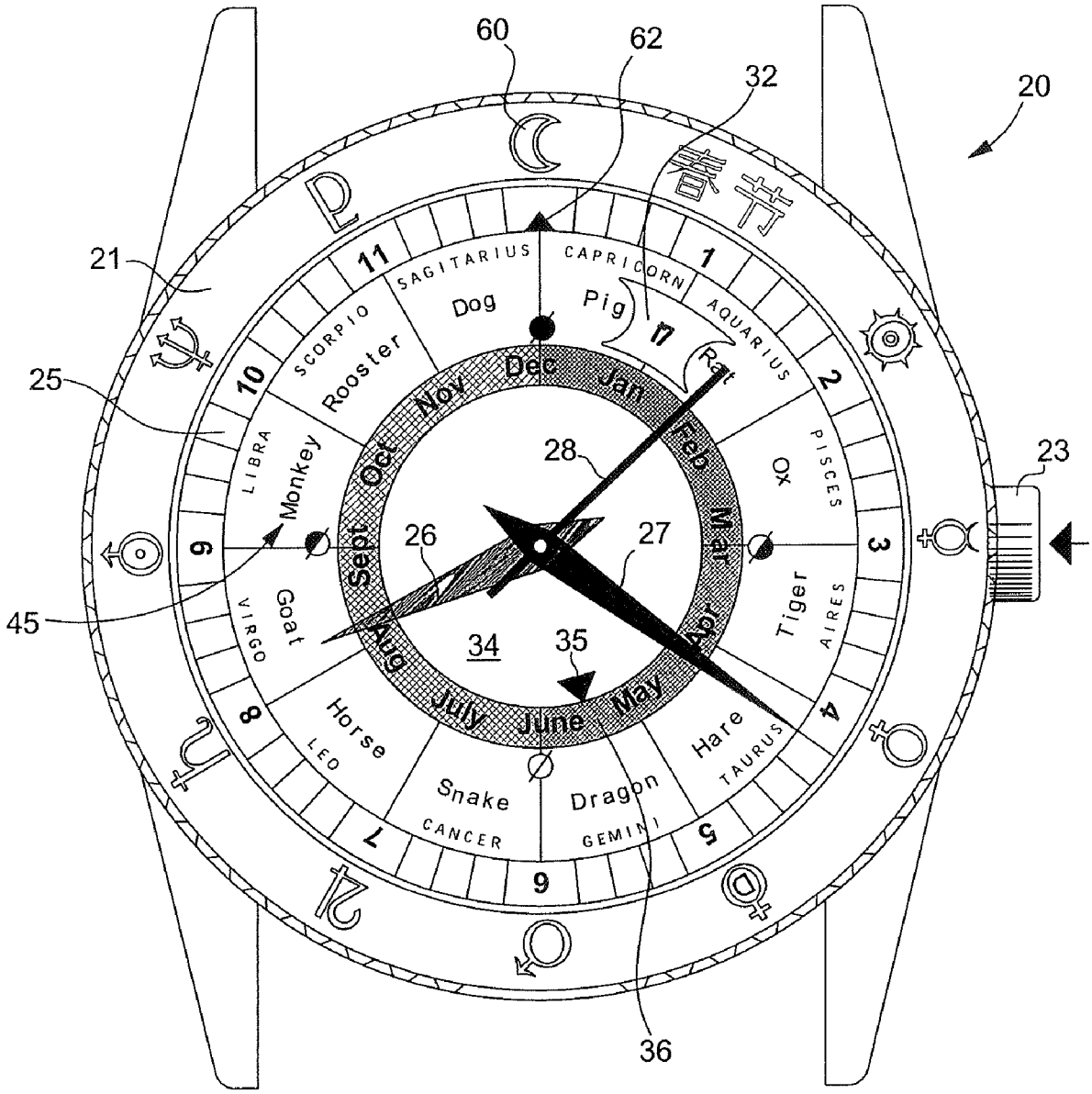
FIG. 6 shows the watch of FIG. 1 in a moon display mode.

In the Moon mode represented by symbol 60, the display assumes the configuration shown in FIG. 6, where the second hand 28 indicates the direction of the moon in relation to the zodiac 44, while the day disc 32 does not indicate the date, but the age of the moon, in other words the day in the lunar month. This indication is replaced by that of the phase of the moon when the watch automatically returns to the standard mode.

In a variant of the embodiment described above, the dial and display elements can be arranged to display, in the standard mode, the dates according to the Chinese calendar or another calendar, e.g. Jewish or Islamic calendar, instead of the Gregorian calendar.

Figure 7:
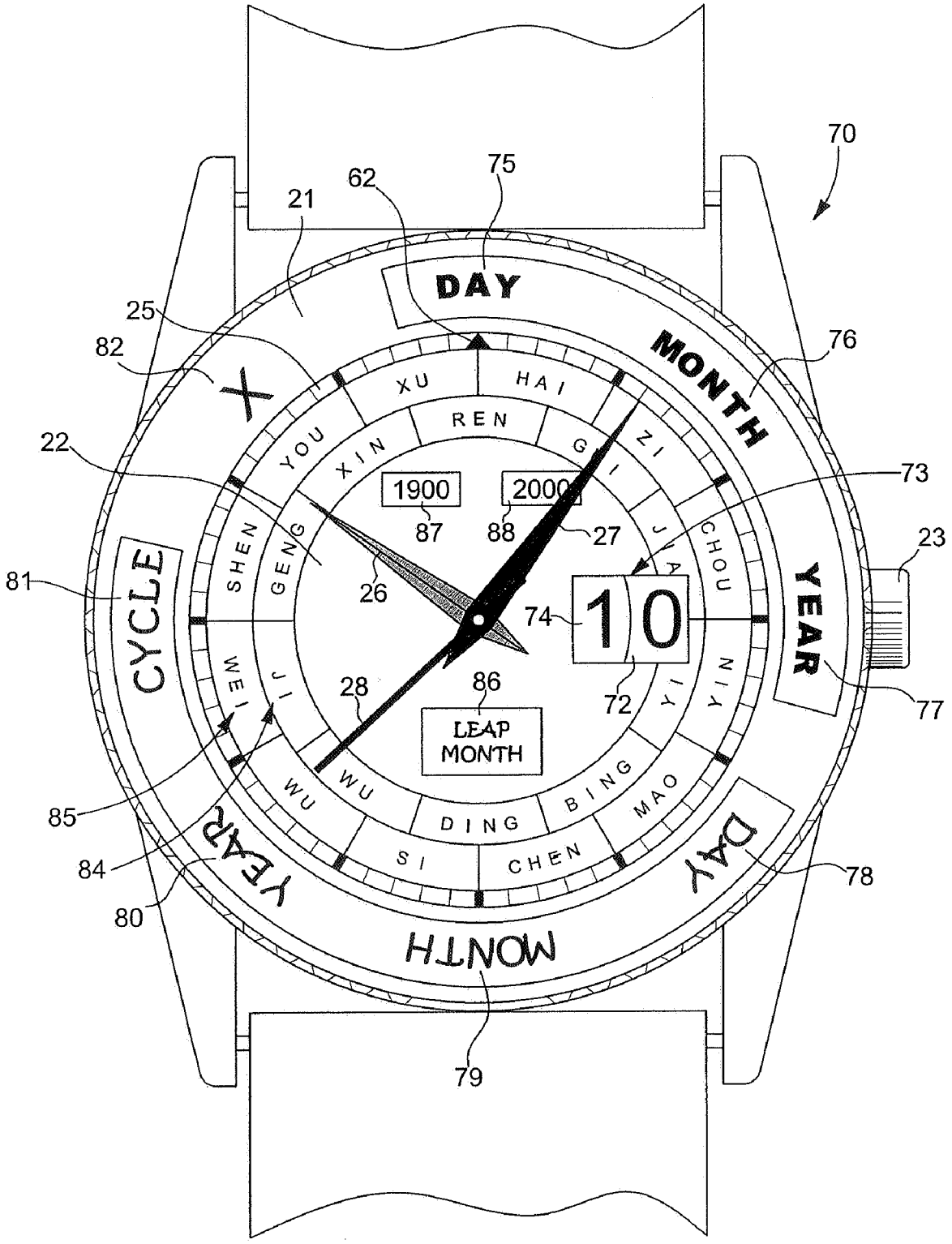
FIG. 7 is a schematic plan view of a second embodiment of a wristwatch according to the invention in a standard display mode based on the Gregorian calendar.
Figure 8:
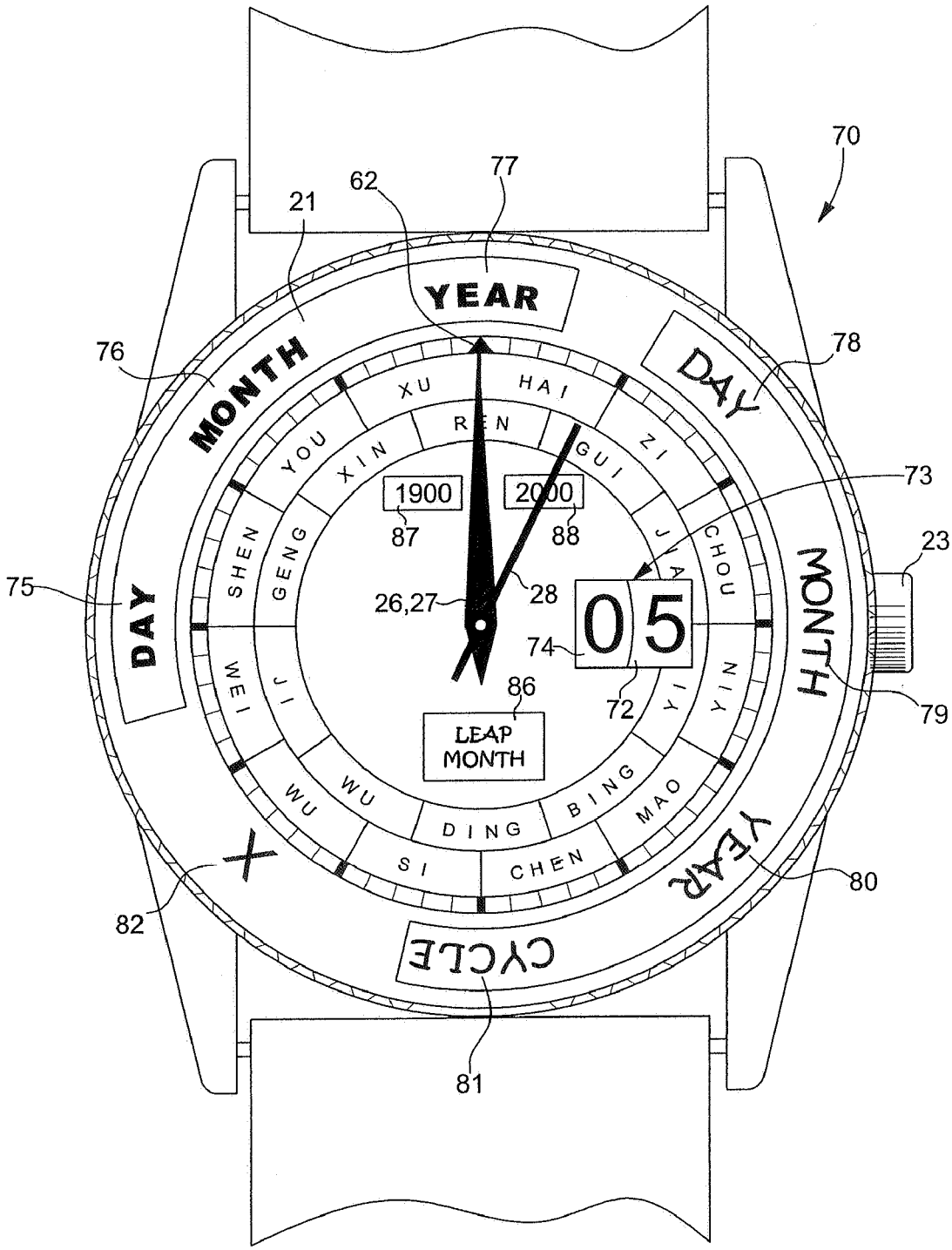
FIG. 8 shows the watch of FIG. 7 in a display mode showing the Gregorian year.
Figure 9:
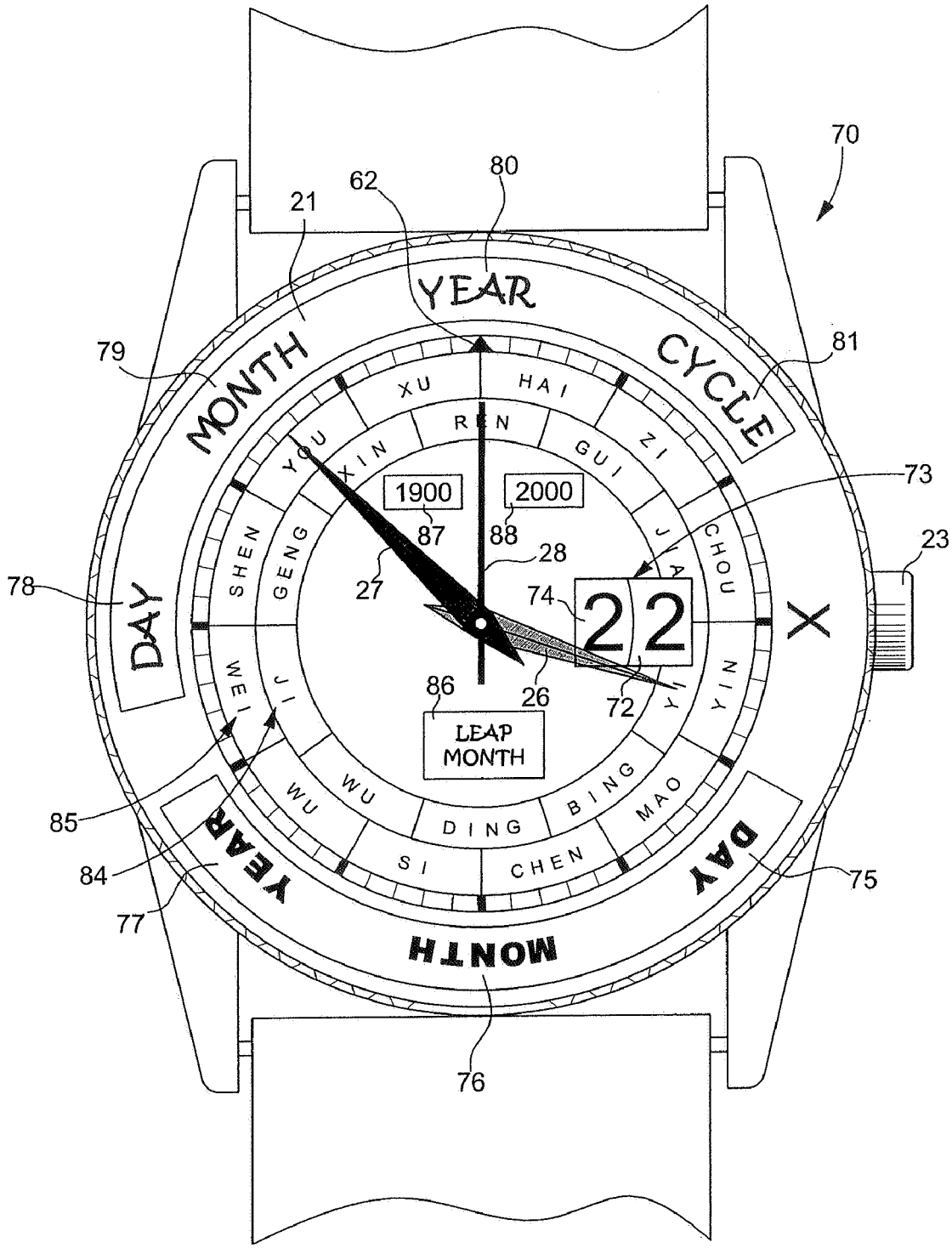
FIG. 9 shows the watch of FIG. 7 in a display mode showing the Chinese year.

In the second embodiment illustrated in FIGS. 7 to 9, an electronic watch 70 is shown, the mechanical construction of which is similar to that of the watch 20 described above, except that the two display discs 32 and 34 of the latter are replaced by two adjacent concentric discs 72 and 74 intended for the display of days and other two-digit numbers in a window 73, each of these discs having at least one series of digits from 0 to 9. Another difference is that the revolving bezel 21 only has eight positions here corresponding to eight function modes, which will be defined below.

The watch 70 is arranged to convert dates of the Gregorian calendar into dates of the Chinese lunisolar calendar and vice versa, and display these. Consequently, the manual control elements 21 and 23 are arranged to allow the user to select the values composing a date of a first of these calendars, then cause the values of the corresponding date in the other calendar to be displayed. The display elements are obviously themselves arranged to be able to display said values, here in a sequential manner, as will be described below.

For the selection or display of a Gregorian date, the revolving bezel 21 functioning as a mode selector has three positions represented by the symbols 75 to 77 marked DAY, MONTH and YEAR. Similarly, to select or display a date of the Chinese calendar, the bezel has four symbols 79 to 81 identified by a different script from the preceding ones and marked DAY, MONTH, YEAR and CYCLE. The eighth position of the bezel 21, marked by a symbol 82, can correspond to any mode, e.g. a mode for initialising the watch, which does not need to be described here.

Besides the above-mentioned discs 72 and 74, the display elements comprise hour 26, minute 27 and second 28 hands, as in the previous example. Inside the time ring 25, the dial 22 has two concentric circular scales serving to indicate the Chinese designation of the years in each traditional sixty year cycle of the Chinese calendar. A first scale 84 is divided into ten equal sectors, in which the names of the ten heavenly stems are inscribed, while the second scale 85 is divided into twelve equal sectors bearing the names of the twelve earthly branches. The inside area of the dial also bears a symbol 86 representing the additional lunar month or leap month (LEAP MONTH) of the Chinese calendar, and two symbols 87 and 88 representing the 20th century and the 21st century of the Gregorian calendar.

To convert a Gregorian date into the corresponding date of the Chinese lunisolar calendar, the watch 70 works in the following manner. Let us assume that the present date is 10 Mar. 2005. Initially, the display is in the standard mode shown in FIG. 7, the watch returning automatically to this mode from whatever other mode if there has been no operation of the control elements 21 and 23 during a pre-programmed period of time, e.g. ten seconds. The hands 26 to 28 indicate the current time in the usual manner on the time ring 25, while the discs 72 and 74 indicate the current day 10 in the window 73. To select the Gregorian day, the user ensures that the corresponding symbol 75 is positioned properly to face the main pointer 62, then briefly presses the crown 23. The hands 26 to 28 are then superposed towards the pointer 62 and symbol 75 to indicate entry into the Gregorian day mode, and this latter remains displayed in the window 73. If the user wanted to choose another Gregorian date, e.g. that of Christmas, he/she should turn the crown 23 in one direction or the other to increment or decrement the day until 25 appears in the window 73. The Gregorian month is then selected by positioning the corresponding symbol 76 to face the pointer 62, and the crown 23 is pressed. The number of the current month, i.e. 03, is then displayed in the window 73, while the hands remain superposed towards the pointer 62. If one wished to select the date of Christmas, all that would be required would be to turn the crown 23 until the number 12 corresponding to December appears in the window 73. Then to select the Gregorian year, the corresponding symbol 77 is positioned to face the pointer 62 and the crown 23 is pressed again. As shown in FIG. 8, the display is then as follows: the discs 72 and 74 display 05 in the window 73, i.e. the tens and units digits of the number of the year, while the second hand 28 is positioned on the symbol 88 to indicate the century. A different year could also be chosen there by turning the crown 23.

The Gregorian date thus selected is filed in memory in the watch and could be converted into a Chinese calendar date either immediately or later, even if the watch has returned to the standard mode in the meantime. For this, the bezel 21 is turned to position the symbol 78 of the Chinese lunar day to face the pointer 62 and the crown 23 is pressed. The lunar day, counted from the day of the new moon which marks the start of the lunar month, is indicated in the window 73 by discs 72 and 74, while the hands 26 to 28 remain superposed towards the pointer 62 and the symbol 78. The symbol 79 of the lunar month is then positioned to face the pointer 62 and the crown 23 is pressed again. The number of the lunar month in the Chinese calendar is then displayed in the window 73. If it is a normal month, the three hands 26 to 28 remain facing the pointer 62. However, if it is an additional month (leap month), for which it may be recalled that it bears the same number as the preceding lunar month, the second hand 28 indicates it by moving onto the corresponding symbol 86.

The bezel 21 is then turned to bring the symbol 80 of the Chinese year to face the pointer 62 and the crown 23 is pressed. For example, for the Gregorian date of 10 Mar. 2005, the display is then as shown in FIG. 9. In the window 73, the discs 72 and 74 indicate that it is the 22nd year of the current sixty year cycle of the Chinese calendar, the hour 26 and minute 27 hands point, on scales 84 and 85, to the respective names of the heavenly stem and earthly branch, which compose the name of the year in question. During this time, the second hand 28 remains pointing in the direction of the pointer 62 and symbol 80 of the year mode. If the user wishes, by turning the bezel 21 to move the cycle symbol 81 to face the pointer 62 and by pressing the crown 23, he/she can display the number of the sixty year cycle in the Chinese calendar in the window 73, while the three hands remain superposed towards the pointer 62.

Conversely, the watch 70 can convert a selected date of the Chinese calendar into a Gregorian date in the same manner, since the electronic circuits of the watch contain a table or an algorithm for correlation between these dates over a large number of years extending from 1900 to 2099 in the present example. The Chinese date in question is selected by positioning symbols 78, 79, 80 and 81 (if necessary) in succession to face pointer 62 and pressing the crown 23 each time, as described above. The values of the corresponding Gregorian date are then displayed by moving symbols 75, 76 and 77 in succession to face pointer 62. The display of each value of the date in the Chinese calendar and in the Gregorian calendar is as described above.

A watch such as watch 70 described above can, of course, be designed to convert dates between other calendars, e.g. between the Gregorian calendar and the Jewish lunisolar calendar, between the Islamic lunisolar calendar and the Chinese lunisolar calendar, etc. By providing a larger number of positions of the revolving bezel 21 or an assembly of control elements to perform the same function, e.g. pushbuttons, it is possible to design a watch that will perform conversions between more than two calendars, since the electronic circuits contain correlation tables or appropriate algorithms.

A person skilled in the art will readily understand that the present invention can be used in different electronic timepieces to those described above, in particular in clocks, small clocks or pocket watches. Moreover, he could envisage variants having different display elements to those shown in the drawings, e.g. a numeric display of certain elements of the dates, as shown in FIG. 3 of the patent application EP 949 549. The control elements could also be configured in other forms. In particular, the selection of the different modes could be achieved by means of pushbuttons on the case or transparent capacitive touch keys on the glass.

What is claimed is:

1. An electronic timepiece comprising manual control means for the selection of different modes and an analog display provided with indicators moved separately by electric motors to indicate the time on a dial in a time mode and other information in one or more other modes, said indicators comprising at least an hour hand and a minute hand, wherein said indicators comprise a day indicator and a month indicator, and wherein at least one of the modes to be selected is an event indication mode, in which the Gregorian date of a movable event is delivered by the electronic circuits of the timepiece and is displayed at least by the day indicator and month indicator, said timepiece having means for the display of the number of the Gregorian year, wherein the dial comprises a day window, of which the two opposite edges are convex towards the interior of the window, and that the day indicator has a rotary disc provided with a series of numbers distributed around a section of a circumference to appear individually in said window, another part of said circumference being provided with an image of the moon, which can occupy various positions in said window to display the phases of the moon in at least one of the modes.

2. An electronic timepiece comprising manual control means for the selection of different modes and an analog display provided with indicators moved separately by electric motors to indicate the time on a dial in a time mode and other information in one or more other modes, said indicators comprising at least an hour hand and a minute hand and being arranged to provide an indication of the day, month and year, and at least one of the modes to be selected being a conversion mode for a given date of a first calendar to a corresponding date of a second calendar, in which said corresponding date is delivered by the electronic circuits of the timepiece and is displayed by at least some indicators, wherein the dial comprises a day window, of which the two opposite edges are convex towards the interior of the window, and that the day indicator has a rotary disc provided with a series of numbers distributed around a section of a circumference to appear individually in said window, another part of said circumference being provided with an image of the moon, which can occupy various positions in said window to display the phases of the moon in at least one of the modes.

* * * * *